US005757305A

United States Patent [19]

Xydis

[11] Patent Number: 5,757,305

[45] Date of Patent: May 26, 1998

[54] TRANSMITTER FOR WIRELESS AUDIBLE INDICATION SYSTEM

[75] Inventor: Thomas G. Xydis, Ann Arbor, Mich.

[73] Assignee: Dimango Products, Brighton, Mich.

[21] Appl. No.: 728,400

[22] Filed: Oct. 9, 1996

Related U.S. Application Data

[63] Continuation of Ser. No. 584,911, Jan. 11, 1996, abandoned, which is a continuation of Ser. No. 282,761, Jul. 29, 1994.

[51] Int. Cl.[6] ..... G08C 19/12

[52] U.S. Cl. ..... 341/173; 341/176; 340/384.1; 340/539; 340/825.69; 340/384.7

[58] Field of Search ..... 341/173, 176; 340/539, 825.69, 870.01, 870.09, 870.39, 384.1, 825.72, 384.7; 455/336, 339

[56] References Cited

U.S. PATENT DOCUMENTS

| | | | |
|---|---|---|---|
| 3,833,895 | 9/1974 | Fecteau | 340/224 |
| 4,064,507 | 12/1977 | Schmitz | 340/420 |
| 4,191,948 | 3/1980 | Stockdale | 340/539 |
| 4,278,967 | 7/1981 | Tanahashi | 340/539 |
| 4,307,465 | 12/1981 | Gellar | 375/76 |
| 4,367,458 | 1/1983 | Hackett | 340/539 |
| 4,520,349 | 5/1985 | Varano | 340/531 |
| 4,523,184 | 6/1985 | Abel | 340/539 |
| 4,554,678 | 11/1985 | Bowman | 455/286 |
| 4,560,978 | 12/1985 | Lemelson | 340/539 |
| 4,581,606 | 4/1986 | Mallory | 340/539 |
| 4,641,127 | 2/1987 | Hogan et al. | 379/40 |
| 4,672,365 | 6/1987 | Gehman et al. | 340/539 |
| 4,749,964 | 6/1988 | Ash | 331/107 A |
| 4,777,474 | 10/1988 | Clayton | 340/539 |
| 4,821,027 | 4/1989 | Mallory et al. | 340/521 |
| 4,853,674 | 8/1989 | Kiss | 340/407 |
| 4,970,494 | 11/1990 | Keeky et al. | 340/567 |
| 4,988,980 | 1/1991 | Graham | 340/692 |
| 5,029,271 | 7/1991 | Meierdierck | 329/347 |
| 5,061,917 | 10/1991 | Higgs et al. | 340/539 |
| 5,146,153 | 9/1992 | Luchaco et al. | 340/825.69 |
| 5,157,405 | 10/1992 | Wycoff et al. | 342/386 |
| 5,237,264 | 8/1993 | Moseley et al. | 340/825.69 |
| 5,250,944 | 10/1993 | Urbas et al. | 340/870.31 |
| 5,252,966 | 10/1993 | Lambropoulos et al. | 341/176 |
| 5,321,229 | 6/1994 | Holling et al. | 341/176 |
| 5,349,329 | 9/1994 | Smith | 340/539 |
| 5,357,541 | 10/1994 | Cowart | 375/1 |
| 5,359,375 | 10/1994 | Clark | 354/131 |
| 5,396,520 | 3/1995 | Degges | 375/316 |
| 5,612,666 | 3/1997 | Xydis | 340/384.1 |

OTHER PUBLICATIONS

Electronics Engineering, Handbook; Fink and Christiansen, 1975 pp. 1–44 – 1–45; 13–30 – 13–33; 14–25 – 14–30.

Fasco Industries Wireless Chime Program, Mar. 15, 1993.

Pamphlet by Dimango Products— Dimango's 1993 Wireless Chime Program.

*Primary Examiner*—Jeffery Hofsass
*Assistant Examiner*—Ashok Mannava
*Attorney, Agent, or Firm*—Brooks & Kushman P.C.

[57] ABSTRACT

A wireless audible indication system comprising a transmitter and a receiver. An embodiment of the transmitter includes a crystal oscillator which produces a signal having a predetermined audio frequency. A duty cycle limiting circuit limits the duty cycle of the oscillator signal to be less than 25%. The limited duty cycle signal is applied to a radio frequency oscillator to produce an amplitude modulated radio frequency signal. An embodiment of the receiver includes a superregenerative detector which provides wide band detection of transmissions about a carrier frequency. A signal processing circuit formed by a cascade of a crystal filter stage, an amplifier/comparator stage, and a detector stage, processes the signal from the superregenerative detector. A sound generator integrated circuit, which generates an audible signal indicative of reception of a transmitted signal, is coupled to the signal processing circuit. Another embodiment of the receiver includes two parallel signal processing paths having different crystal filter stages, which allows use with two different transmitters.

21 Claims, 4 Drawing Sheets

TRANSMITTER FOR WIRELESS AUDIBLE INDICATION SYSTEM

This is a continuation of application(s) Ser. No. 08/584,911 filed on Jan. 11, 1996, now abandoned, which is a continuation of Ser. No. 08/282,761 filed on Jul. 29, 1994.

TECHNICAL FIELD

The present invention relates generally to doorbell systems, and particularly to wireless doorbell systems which employ radio frequency transmitters and receivers.

BACKGROUND ART

Wireless doorbell systems have become an increasingly popular option for persons wishing either to replace their current doorbell or to add additional doorbell buttons at their place of residence. A general wireless doorbell system comprises at least one battery-operated, radio-frequency transmitter and a radio-frequency receiver. In response to the depression of a button on the transmitter, a radio-frequency signal is transmitted for reception by the receiver. The receiver alerts the user that the doorbell button has been depressed by producing an audible signal, such as a tone or a melody, upon detecting the transmitted radio-frequency signal.

The installation of a battery-powered wireless doorbell system is performed by simply inserting batteries into the transmitter and receiver, and mounting them at their desired locations. Because no wiring is required between the transmitter and the receiver, the resulting installation of a wireless doorbell system is a relatively easy task. This ease in installation partially accounts for the popularity of wireless doorbell systems.

One drawback of using a wireless doorbell system is that the batteries in the transmitter and receiver must be replaced when they are insufficiently powered. In practice, the transmitter batteries need not be replaced as often as the receiver batteries. This is due to the fact that the receiver consumes battery power continually in determining whether or not a radio-frequency signal was transmitted, whereas the transmitter consumes battery power only when its button has been depressed. Typically, the batteries in the receiver need to be replaced after a number of months of operation.

Another drawback of previous wireless doorbell systems is the limited range which results from the limited average field strength which can be transmitted by the transmitter under Federal Communication Commission (FCC) Part 15 rules. The limited range results in a limiting the scope of application of previous wireless doorbell systems.

SUMMARY OF THE INVENTION

For the foregoing reasons, the need exists for a wireless doorbell system having an increased transmission range and an extended battery life.

It is thus an object of the present invention to extend the battery life in a wireless doorbell receiver.

A further object of the present invention is to increase the transmission range in a wireless doorbell system.

A still further object of the present invention is to reduce the sensitivity of a wireless doorbell system to interference from other Part 15 systems.

In carrying out the above objects, the present invention provides a transmitter for use with a corresponding receiver in an audible indication system. A signal generator produces a pulsed signal of a predetermined frequency having a duty cycle less than 25%. A radio frequency oscillator, coupled to the signal generator, produces a carrier signal whose amplitude is modulated in dependence upon the pulsed signal.

In carrying out the above objects, the present invention further provides a transmitter for use with a corresponding receiver in an audible indication system. A crystal oscillator produces a first signal having a predetermined frequency. A duty cycle limiting circuit, coupled to the crystal oscillator, forms a second signal by limiting the duty cycle of the first signal to be substantially equal to 10%. A radio frequency oscillator is coupled to the signal generator to produce a carrier signal whose amplitude is modulated in dependence upon the second signal.

These and other features, aspects, and advantages of the present invention will become better understood with regard to the following description, appended claims, and accompanying drawings.

BEST MODE FOR CARRYING OUT THE INVENTION

Embodiments of the present invention overcome the disadvantages of previous wireless doorbell systems by using a narrow band tone modulated system for communication between the transmitter and receiver. This system employs low frequency crystals for both modulating a UHF carrier signal in the transmitter, and detecting signals in the receiver. Further, a self-biasing amplifier/comparator is used to process signals in the receiver.

Figure 1:
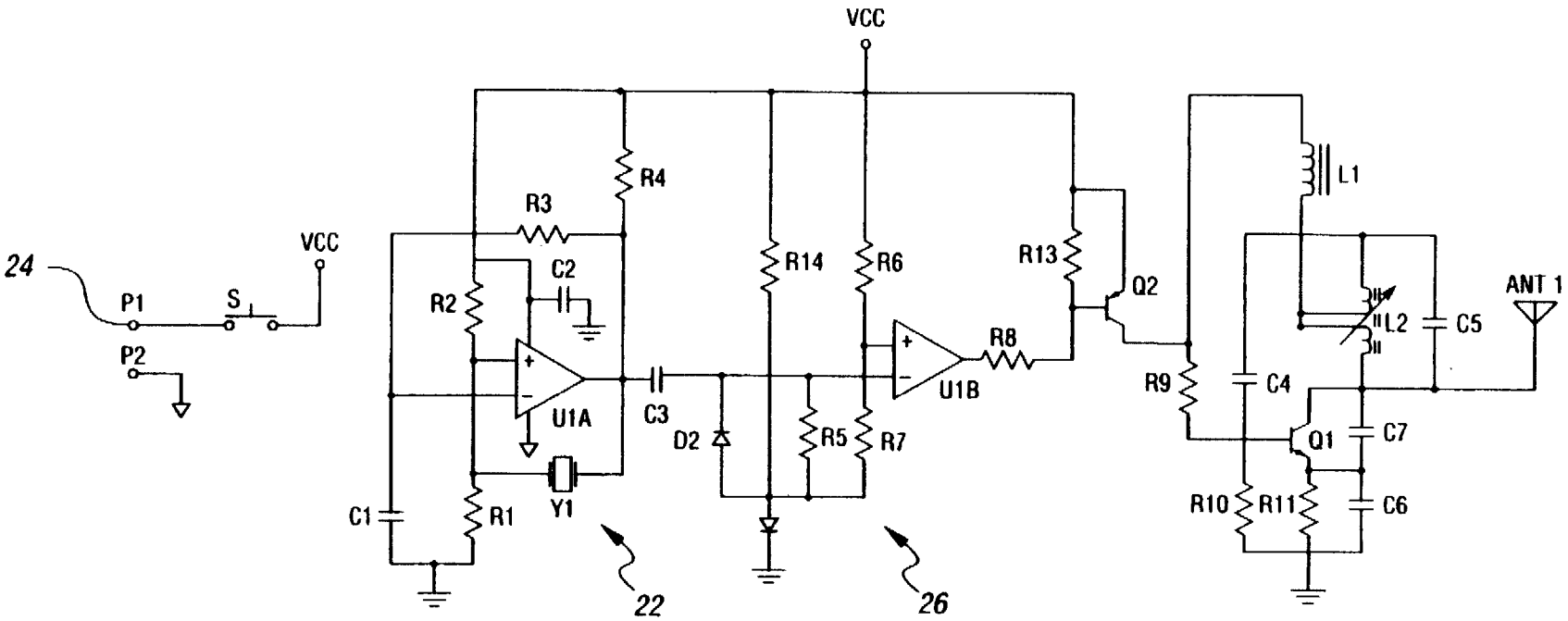
FIG. 1 is a schematic drawing of an embodiment of a transmitter in accordance with the present invention.

FIG. 1 is a schematic diagram of an embodiment of a transmitter for a general audible indication system, such as a wireless doorbell system. A radio frequency oscillator circuit 20 is formed by a transistor Q1, coils L1 and L2, capacitors C4, C4, C6, and C7, and resistors R9, R10, and R11. The frequency of the oscillator is aligned to its desired carrier frequency by varying the inductance of coil L2. In a preferred embodiment of wireless doorbell system, the carrier frequency is selected to be in the ultra-high frequency (UHF) range, and more specifically, 315 MHz. The coil L2 further acts as a radiating element for the transmitter.

A crystal oscillator circuit 22 is formed by an operational amplifier U1A, a crystal Y1, resistors R1, R2, R3, and R4, and capacitors Cl and C2. In response to depressing a pushbutton switch S1, a connection is made between a battery terminal 24 and a point on the circuit indicated by VCC. This connection causes the voltage of a battery connected to the terminal 24 to be applied to the crystal oscillator circuit 22, which causes the circuit 22 to oscillate at a frequency determined by the crystal Y1. Embodiments of the present invention employ crystals which oscillate in the low frequency range. In preferred embodiments, either a 32.768 kHz crystal or a 38 kHz crystal is selected.

The output of the crystal oscillator circuit 22 is applied to a duty cycle limiting circuit 26 which limits the duty cycle of the on/off modulation of the crystal oscillator 22. The duty cycle limiting circuit 26 comprises diodes D2 and D3, an operational amplifier U1B, a capacitor C3, and resistors R5, R6, R7, and R14. The output of the operational amplifier U1B is coupled by a resistor R8 to the base of a transistor Q2. The collector of the transistor Q2 is coupled to the oscillator circuit 20 so that the on/off low frequency signal modulates the radio frequency carrier signal formed by the oscillator circuit 20.

By reducing the duty cycle of the crystal oscillator to be less than 25%, the maximum peak power of the transmitter can be increased without increasing the average field strength. In preferred embodiments, the duty cycle is less than 20%. In an exemplary embodiment, the duty cycle is limited to approximately 10%. Therefore, as a result of limiting the duty cycle using circuit 26, the maximum peak power allowed by the FCC can be transmitted in order to increase the effective range of the transmitter.

Figure 2:
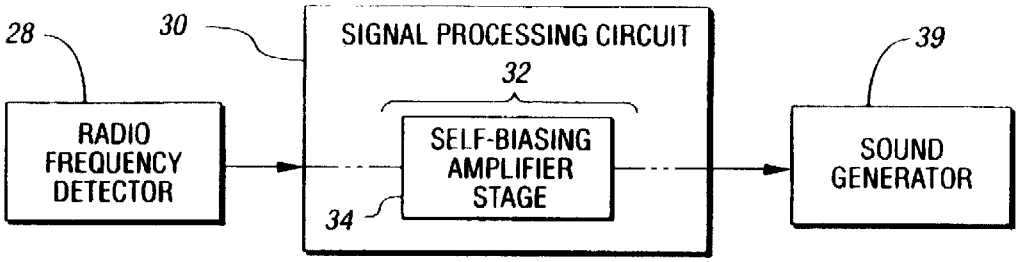
FIG. 2 is a block diagram of an embodiment of a receiver in accordance with the present invention.
Figure 2:
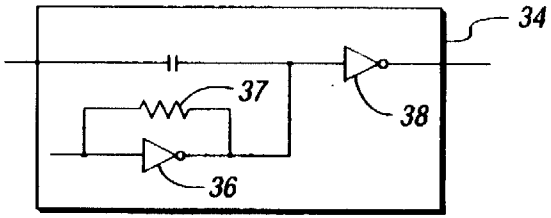

FIG. 2 illustrates a block diagram of an embodiment of a receiver in accordance with the present invention. A radio frequency detector 28 produces a baseband signal upon receiving a radio frequency signal from a corresponding transmitter. A signal processing circuit 30, coupled to the radio frequency detector 28, includes a series of cascaded stages 32 which produces a second signal in dependence upon the first signal. The series of cascaded stages 32 includes an self-biasing amplification/comparator stage 34 formed using two inverter gates. Negative feedback is applied to a first inverter gate 36 by a resistor 37 which couples the gate input and the gate output. Consequently, the output voltage of the first inverter gate is substantially equal to the switching threshold of the gate. The output of the first inverter gate 36 is coupled to the input of a second inverter gate 38 in order to bias the second inverter gate 38 in the linear region. As a result, the second inverter gate 38 produces, at its output, a high-gain amplification of signals applied to its input. A sound generator 39 is coupled to the signal processing circuit 30. The sound generator 39 generates an audible signal when the second signal is indicative of reception of the transmitted signal.

Figure 3:
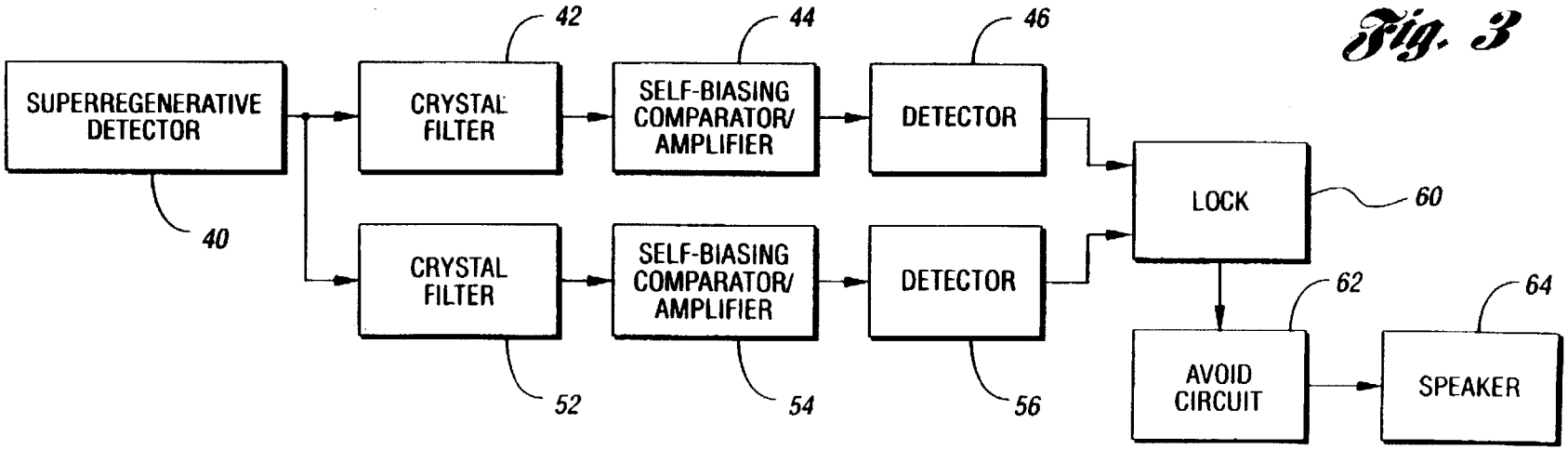
FIG. 3 is a block diagram of another embodiment of a receiver in accordance with the present invention.

FIG. 3 illustrates a block diagram of an embodiment of a receiver in accordance with the present invention. The front end of the receiver includes a superregenerative detector 40 which provides wide band detection of transmissions about a preselected carrier frequency. The preselected carrier frequency corresponds to the carrier frequency of a transmitter designed for use with the receiver. The output of the superregenerative detector 40 is applied to a crystal filter 42. The crystal filter 42 provides a very narrow band of filtering about the crystal frequency in the corresponding transmitter. The output of the crystal filter 42 is applied to a self-biasing amplifier/comparator 44 which provides amplification of the narrow band signal. The self-biasing comparator 44 is constructed using a standard integrated circuit (IC) inverter biased using another inverter from the same IC. The output of the self-biasing comparator 44 is applied to a detector circuit 46 which produces the envelope of the narrow band signal.

The output of the superregenerative detector 40 is also applied to a similar cascade of a crystal filter 52, a self-biasing amplifier/comparator 54, and a detector 56. The crystal filter 52 has a different resonant frequency than the first crystal filter 42 to allow detection of two different transmitters. The detectors 46 and 56 are applied to a logic circuit 60 which determines whether or not a transmission has been detected, and for which frequency this detection has occurred. The output of the logic circuit 60 is applied to an audio circuit 62 which produces a tone or series of tones in response to a detected transmission. The audio circuit 62 is coupled to a speaker 64 which allows the tone or series of tones to be heard by a user.

Figure 4:
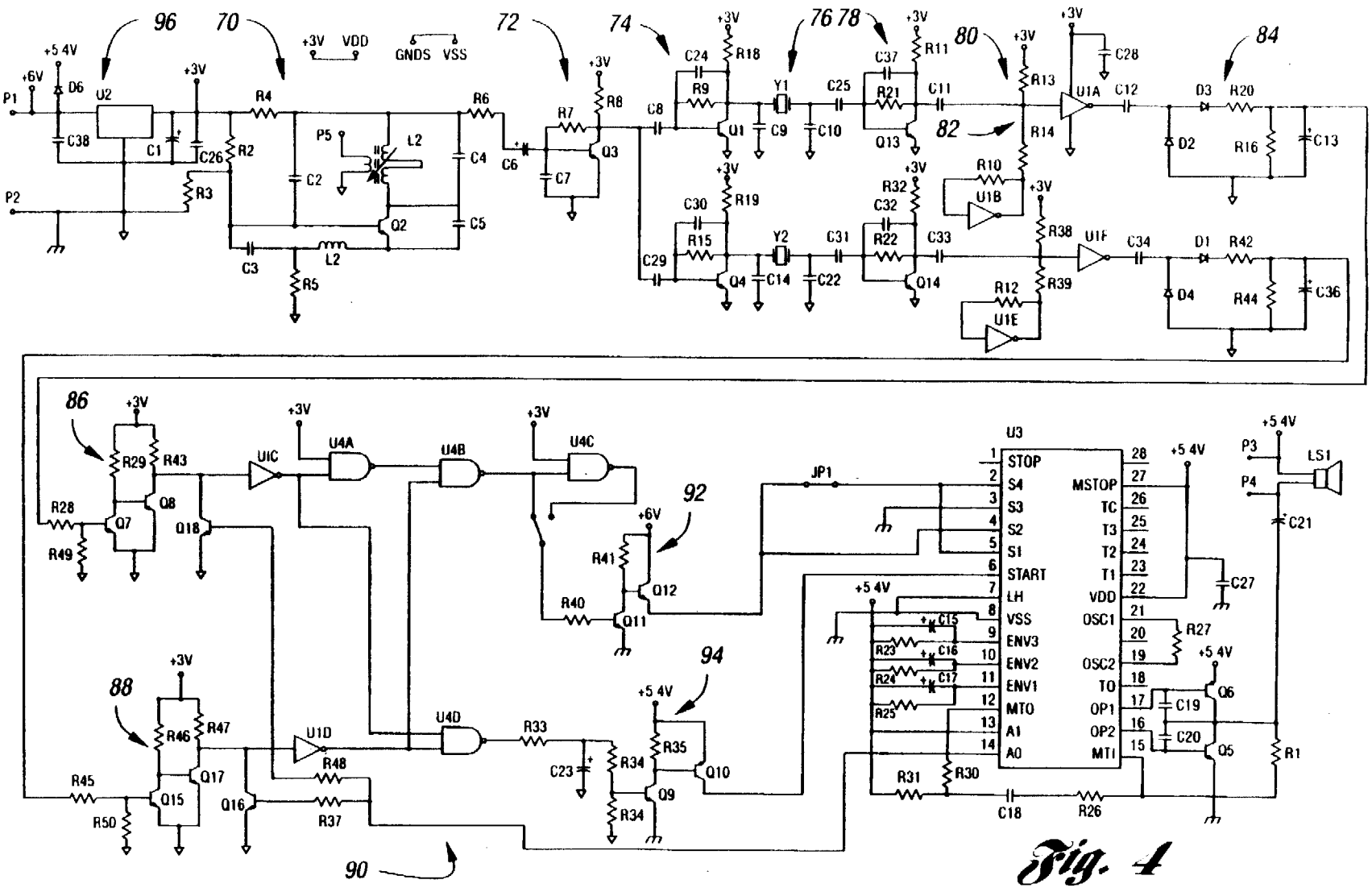
FIG. 4 is a schematic drawing of an embodiment of a receiver.

A schematic drawing of an embodiment of the receiver of the present invention is shown in FIG. 4. A superregenerative detector 70 comprises a transistor Q2, coils L1 and L2, capacitors C3, C4, and C5, and resistors R2, R3, R4, and R5. The superregenerative detector 70 produces the modulation envelope of the UHF carrier signal. The output of the superregenerative detector 70 is coupled to a transistor amplifier circuit 72 by a resistor R6 and a capacitor C6. The transistor amplifier circuit 72, which comprises a transistor Q3, resistors R7 and R8, and a capacitor C7, is used to provide both gain and buffering of the modulation envelope signal.

The signal from the collector of the transistor Q3 is applied to two parallel crystal filter/detector signal processing paths via coupling capacitors C8 and C29. The first path includes an amplification and buffering stage 74 comprising a transistor Q1, a capacitor C24, and resistors R9 and R18. The output of this stage 74, at the collector of Q1, is applied to a crystal filter 76 formed using a crystal Y1. The crystal Y1 is of the low-frequency audio tuning fork variety, and as such, the crystal filter is not a conventional configuration. In a preferred embodiment, the resonant frequency of the crystal Y1 is selected to be 32.768 kHz. The output of the crystal filter 76 is applied to a buffering stage 78 comprised by a transistor Q13 and its associated circuitry.

The output of the buffering stage 78 is applied to a self-biasing amplifier/comparator stage 80 by a coupling capacitor C11. The self-biasing amplifier/comparator stage 80 employs an inverter gate U1A, such as one found on a 4069 integrated circuit, which is biased in the linear region by another inverter gate U1B from the same integrated circuit chip. A resistor R12 is connected between the input and output of the inverter gate U1B. The negative feed-back which results causes the output voltage of the gate U1B to approach its switching threshold voltage. Since gates U1A and U1B are from the same integrated circuit chip, and thus, are on the same substrate, they exhibit nearly identical switching threshold voltages. A voltage divider 82 formed by resistors R13 and R14 produces a DC voltage which is slightly greater than the threshold voltage of the gate U1B. This DC voltage is applied to the input of the gate U1A to provide biasing in the linear region. The output of the inverter gate U1A is a reproduction of the audio tone that was modulated in the radio frequency carrier.

The audio tone at the output of gate U1A is rectified and detected by a low frequency detector circuit 84 comprising diodes D2 and D3, resistors R20 and R16, and a capacitor C13. This circuit 84 produces an output signal representative of the on/off modulation signal applied to the audio-tone of frequency determined by the crystal Y1.

The second crystal filter/detector path is equivalent to the first path with the exception of a crystal Y2 which is employed. The crystal Y2 is selected to have a different resonant frequency than that of the crystal Y1 used in the first path. This allows the receiver to be used with two transmitters, each having a different modulating frequency. In a preferred embodiment, the resonant frequency of the crystal Y2 is selected to be 38 kHz.

The outputs of the first and second detector paths are applied to corresponding amplification stages. The first detector output is applied to an amplification stage 86 comprised of transistors Q7 and Q8, and resistors R28, R29, R43, and R49. The second detector output is applied to an identical amplification stage 88 comprised of transistors Q15 and Q17, and resistors R45, R46, R47, and R50. The outputs of these amplification stages 86 and 88 have logic levels consistent with the devices employed in a subsequent logic stage.

It is noted that the amplification stages 86 and 88 are not required in other receiver embodiments. In the embodiment of FIG. 4, the amplification stages 86 and 88 are employed to allow a subsequent music integrated circuit to inhibit signals from the first and second detector paths, using transistors Q18 and Q16.

A logic stage 90 is comprised of two inverter gates U1C and U1D, and four NAND gates U4A, U4B, U4C, and U4D. In a preferred embodiment, the inverter gates U1C and U1D are two previously unused gates from the 4069 hex inverter IC, and the four NAND gates are taken from a 4011 quad NAND IC. The logic stage is used to select which song is to be played in response to a detected audio tone. The output of NAND gate U4C provides a high signal when a transmission is detected by the first detection path and no transmission is detected by the second detection path. A switch S1 can selectively apply either the input or output of the NAND gate U4C, which is wired to act as an inverter gate, to a subsequent level modification circuit. The output of NAND gate U4D provides a signal dependent upon a logical OR of the outputs of the two detection paths.

A first level translation circuit 92, comprised of transistors Q11 and Q12, and resistors R40 and R41, is coupled to the pole of the switch S1. The first level translation circuit 92 provides logical output levels based on 5.4 volts as opposed to the 3 volts used in the previous stages. Similarly, a second level translation circuit 94, comprised of transistors Q9 and Q10, resistors R33, R34, R35, and R36, and capacitor C23, is coupled to the output of the NAND gate U4D.

A music integrated circuit U3 is coupled to the first and second level translation circuits 92 and 94. In a preferred embodiment, the music integrated circuit U3 is a standard music generator chip such as an M1131AJL wired in a standard suggested mode of application. Although capable of operating with a 3 volt supply, the music integrated circuit U3 is supplied with a voltage of 5.4 volts in order to provide a desirable volume level and sound quality. With the switch S1 in the "normal" position, a 32.768 kHz tone causes a "ding dong" sound to be generated, and a 38 kHz tone causes the generation of a Westminster chime sound. With the switch S1 in the "reverse" position, the song assignments are reversed for the two audio tones. As a result, the receiver can be used with two transmitters, one having a 32.768 kHz modulated tone and another having a 38 kHz modulated tone, located at two different locations at a person's residence. For example, a user can have one transmitter located at the front door and the other transmitter at the back door, and be able to distinguish between the two using a single receiver.

The voltage sources used to power the above-mentioned circuits in the receiver are formed by a power supply, indicated generally by reference numeral 96. A 6 volt battery source is applied between terminals P1 and P2. In a preferred embodiment, this 6 volt battery source is formed by a series combination of four "D" type cells, each producing 1.5 volts. The 3 volt source is generated by a low-current, voltage regulator U2, in combination with capacitors C1, C26, and C38. The low-current regulator U2 maintains a nearly constant current draw on the batteries regardless of their output voltage. The 5.4 volt source is generated by coupling a diode D6 directly to the 6 volt battery source.

The use of a 3 volt source to operate many of the circuits in the receiver is beneficial for the following reasons. First, the 6 volt battery source can be drawn down to half of its initial voltage without affecting the operation of the 3 V circuits in the receiver. As a result, the receiver is capable of operation over a significantly larger portion of the full life of the batteries. Secondly, the threshold voltage of the MOSFETs in the 4069 is near to 3 volts. As a result of operating the 4069 near this threshold voltage, its quiescent current consumption is dramatically reduced. In a preferred embodiment, the entire receiver requires only approximately 400 microamps to run. This results in a battery life of approximately four years using the recommended four "D" type, alkaline cells.

Figure 5:
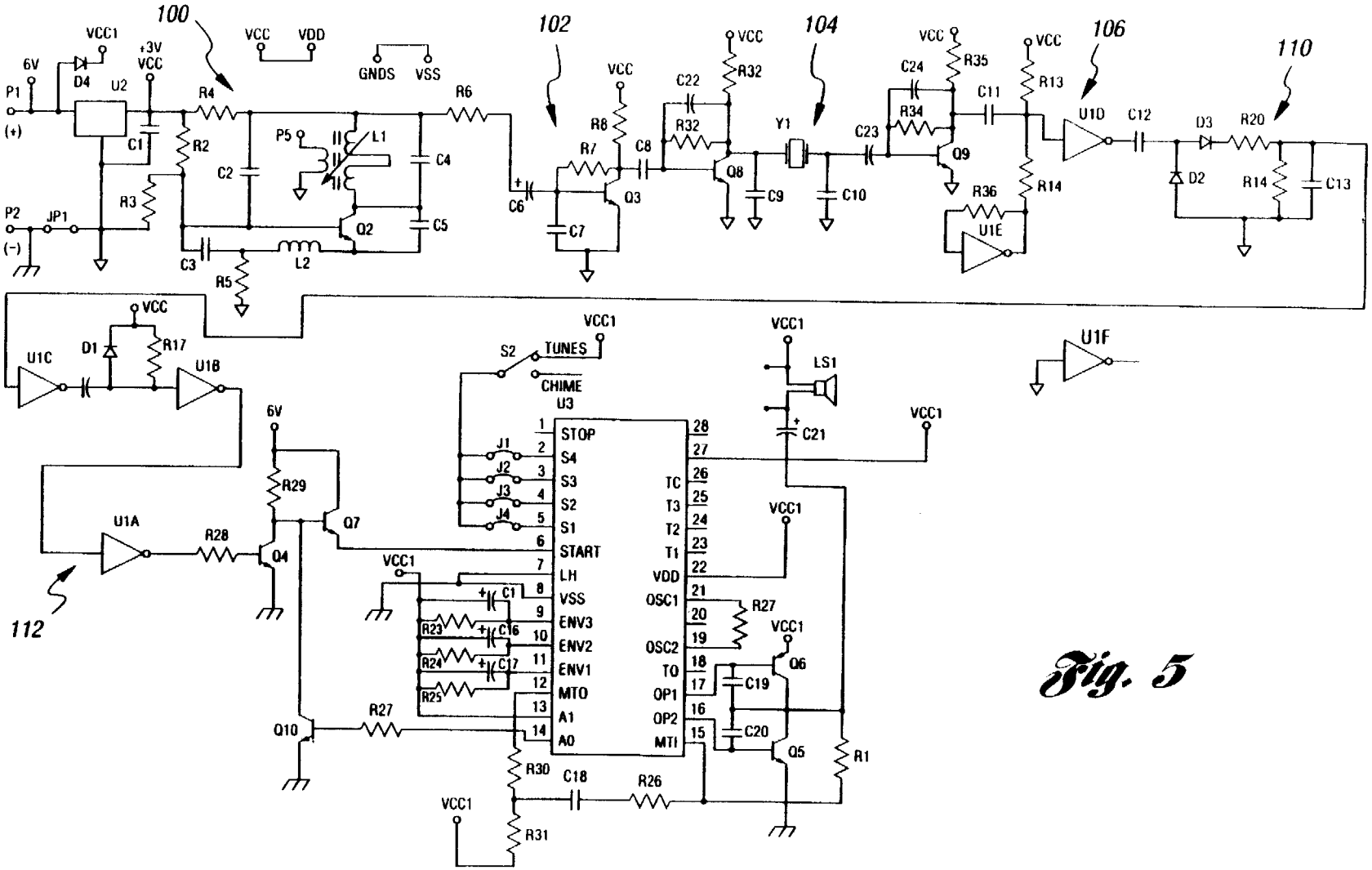
FIG. 5 is a schematic drawing of an alternative embodiment of a receiver.

An alternative embodiment of a receiver in accordance with the present invention is illustrated by the schematic drawing in FIG. 5. This embodiment is a reduced embodiment of the receiver of FIG. 4. The receiver includes a superregenerative UHF receiver 100 which converts an AM 315 MHz signal to its base band modulation signal. A buffer stage 102 comprised of a transistor Q3 and associated circuitry provides both a low frequency gain and filtering of noise produced by the superregenerative receiver 100. An audio crystal filter 104 is formed using transistors Q8 and Q9, a crystal Y1, and associated circuitry. The filter 104 provides bandpass filtering with a band width of approximately 30 Hz. A self-biasing comparator 106 is formed by an inverter gate U10 biased by another inverter gate U11. Diodes D2 and D3, resistors R16 and R20, and a capacitor C13 form a low frequency peak detector 110 which rectifies the audio frequency signal detected by the crystal filter 104.

A logic stage 112 comprised of inverter gates U1A, U1B, and U1C performs a logic translation and buffering of the peak detector output for application to a music chip U3. The song which is played by the music chip U3 is selectable by cutting jumper wires J1, J2, J3, and J4. A switch S2 allows a user to select either a song determined by the jumper wires or a standard "ding dong" sound. A power supply circuit 114 is comprised of a low current 3 volt regulator U2 to power the RF and signal processing circuits, and a diode D4 to produce a 5.4 volt source to power the music chip U3.

Because the alternative receiver embodiment includes only one crystal detection path, it can be manufactured at a lower cost than the receiver of FIG. 4. In a preferred embodiment, this receiver is powered by four "AA" type batteries in order to reduce its dimensions physically, and result in an economy version of the receiver of FIG. 4. This preferred embodiment has a battery life of approximately one year under normal operating conditions.

Embodiments of the present invention have many advantages. One such advantage results from the use of a narrow band crystal filter. By narrowing the bandwidth of the filter, the effective signal-to-noise ratio of the receiver is greatly increased. Hence, the effective narrow bandwidth of the crystal filter improves the range and performance of the receiver. Moreover, the potential for interference from other Part 15 systems which utilize pulse code modulation or pulse position modulation is minimized. The longer range which results from the use of audio crystals in both the transmitter and the receiver expands the scope of application of the wireless system. For example, the wireless system of the present invention can be used in such applications as doorbell signaling to a boat dock, or to an area near a pool.

Embodiments of the present invention are further advantageous in their use of a self-biasing amplifier/comparator stage. In other designs which utilize audio crystal filtering for radio frequency applications, an inverter gate employed as an amplifier/comparator is biased by means of a potentiometer. Because of the sensitivity of the threshold voltage to changes in temperature and aging of the gate, the bias voltage in previous designs were set higher than optimal for best range. By using the self-biasing scheme, a temperature-stable biasing is achieved, which results in an improved range and improved performance of the receiver.

Another advantage is the extended battery life of the receiver of the present invention. The extended battery life results from operating the CMOS devices near the threshold voltage of the MOS transistors therein, and from powering the radio frequency detector and signal processing stages at half of the full-power battery voltage. Embodiments which employ four "D" type alkaline cells are capable of operating four years without battery replacement. This is a significant improvement over previous receivers whose battery life is typically measured in terms of months.

It is noted that the teachings of the above-described embodiments are also applicable to a general wireless actuator system. Such a system includes a transmitter capable of transmitting a radio frequency signal, and a receiver which actuates a device in response to receiving the transmitted RF signal. In place of a sound generator, the receiver includes an actuator which actuates the device in dependence upon an electrical signal.

While the best mode for carrying out the invention has been described in detail, those familiar with the art to which this invention relates will recognize various alternative designs and embodiments for practicing the invention as defined by the following claims.

What is claimed is:

1. In combination with a wireless doorbell receiver having a wide band superregenerative detector coupled to a crystal filter, the superregenerative detector having a bandwidth about a carrier frequency, a wireless doorbell transmitter for use with the wireless doorbell receiver, the transmitter comprising:

a crystal oscillator which produces a first signal having a predetermined frequency, the crystal oscillator utilizing a first low frequency crystal to produce the first signal;

a duty cycle limiting circuit, coupled to the crystal oscillator, which forms a pulsed signal by limiting the duty cycle of the first signal to be less than 25%; and a radio frequency oscillator, coupled to the duty cycle limiting circuit, which produces a carrier signal at the carrier frequency and whose amplitude is modulated in dependence upon the pulsed signal, wherein the superregenerative detector detects the carrier signal and produces a baseband output that is applied to the crystal filter, the crystal filter utilizing a second low frequency crystal to provide a narrow band of filtering about the predetermined frequency.

2. The combination of claim 1 wherein the first and second low frequency crystals are low frequency audio tuning fork crystals.

3. The combination of claim 1 wherein the first and second low frequency crystals each have a resonant frequency near 32.768 kHz.

4. The combination of claim 1 wherein the first and second low frequency crystals each have a resonant frequency near 38 Hz.

5. The combination of claim 1 wherein the carrier frequency is in an ultra-high frequency band.

6. The combination of claim 5 wherein the carrier frequency is near 315 MHz.

7. The combination of claim 1 wherein the radio frequency oscillator includes a coil which acts as a radiating element for the carrier signal whose amplitude is modulated.

8. The combination of claim 1 wherein the transmitter further comprises a pushbutton switch for selectively connecting and disconnecting the crystal oscillator from a power supply, wherein the crystal oscillator is connected to the power supply when the pushbutton switch is depressed, and wherein the crystal oscillator is disconnected from the power supply when the pushbutton switch is released.

9. The combination of claim 8 wherein the pushbutton switch further selectively connects and disconnects the duty cycle limiting circuit from the power supply, wherein the duty cycle limiting circuit is connected to the power supply when the pushbutton switch is depressed, and wherein the duty cycle limiting circuit is disconnected from the power supply when the pushbutton switch is released.

10. The combination of claim 1 wherein the duty cycle is less than 20%.

11. The combination of claim 1 wherein the duty cycle is near 10%.

12. A wireless doorbell transmitter for use with a corresponding wireless doorbell receiver having a wide band superregenerative detector coupled to a crystal filter utilizing first low frequency crystal to provide a narrow band of filtering about a predetermined frequency the wireless doorbell transmitter powered by a power supply, the wireless doorbell transmitter comprising:

a pushbutton switch;

a crystal oscillator selectively coupled to the power supply by the pushbutton switch, the crystal oscillator producing a first signal in response to depressing the pushbutton switch, the crystal oscillator utilizing a second low frequency crystal to produce the first signal at the predetermined frequency;

a duty cycle limiting circuit coupled to the crystal oscillator and selectively coupled to the power supply by the pushbutton switch, the duty cycle limiting circuit forming a second signal by limiting the duty cycle of the first signal to be less than 25%; and a radio frequency oscillator, coupled to the duty cycle limiting circuit, which produces a UHF carrier signal having a carrier frequency and whose amplitude is modulated in dependence upon the second signal, wherein the superregenerative detector detects the carrier signal and produces an output that is applied to the crystal filter.

13. The wireless doorbell transmitter of claim 12 wherein the carrier frequency is near 315 MHz.

14. The wireless doorbell transmitter of claim 12 wherein the radio frequency oscillator includes a coil which acts as a radiating element for the carrier signal whose amplitude is modulated.

15. The wireless doorbell transmitter of claim 12 wherein the crystals oscillator is connected to the power supply when the pushbutton switch is depressed, and wherein the crystal oscillator is disconnected from the power supply when the pushbutton switch is released.

16. The wireless doorbell transmitter of claim 15 wherein the duty cycle limiting circuit is connected to the power supply when the pushbutton switch is depressed, and wherein the duty cycle limiting circuit is disconnected from the power supply when the pushbutton switch is released.

17. The wireless doorbell transmitter of claim 12 wherein the first and second low frequency crystals each have a resonant frequency near 32.768 KHz.

18. The wireless doorbell transmitter of claim 12 wherein the first and second low frequency crystals each have a resonant frequency near 38 kHz.

19. A wireless doorbell transmitter for use with a corresponding wireless doorbell receiver having a crystal filter, the crystal filter having a center frequency selected from the group consisting of 32.768 kHz and 38 kHz, the wireless doorbell transmitter powered by a power supply, the wireless doorbell transmitter comprising:

a pushbutton switch;

a crystal oscillator selectively coupled to the power supply by the pushbutton switch, the crystal oscillator producing a first signal having a predetermined frequency in response to depressing the pushbutton switch, the crystal oscillator utilizing a low frequency crystal to produce the first signal, the low frequency crystal having a resonant frequency selected from the group consisting of 32.768 kHz and 38 kHz;

a duty cycle limiting circuit coupled to the crystal oscillator and selectively coupled to the power supply by the pushbutton switch, the duty cycle limiting circuit forming a second signal by limiting the duty cycle of the first signal to be less than 20%; and a radio frequency oscillator, coupled to the duty cycle limiting circuit, which produces a UHF carrier signal near 315 MHz whose amplitude is modulated in dependence upon the second signal;

wherein the corresponding wireless doorbell receiver includes a wide band superregenerative detector having a bandwidth about a center frequency near 315 MHz, and produces a baseband output that is applied to the crystal filter when the carrier signal is detected, and wherein the receiver produces an audible indication in response to depressing the pushbutton switch.

20. A wireless doorbell system comprising:

a pushbutton switch;

a remote transmitter selectively coupled to a power supply by the pushbutton switch, the transmitter having a crystal oscillator utilizing a first low frequency crystal to produce a first signal at a predetermined frequency, the crystal oscillator being coupled to a duty cycle limiting circuit which forms a second signal by limiting the duty cycle of the first signal to be less than 25%, the duty cycle limiting circuit being coupled to a radio frequency oscillator which produces a carrier signal at a carrier frequency in which carrier signal amplitude is modulated by the second signal;

a wide band superregenerative detector having a bandwidth about the carrier frequency;

a crystal filter utilizing a second low frequency crystal to provide a narrow band of filtering about the predetermined frequency, the crystal filter being coupled to the superregenerative detector and producing a crystal filter output by filtering a baseband output of the superregenerative detector;

a sound generator capable of producing an audible indication;

signal processing circuit coupled to the crystal filter, the signal processing circuit processing the crystal filter output and activating the sound generator to produce the audible indication in response to depressing the pushbutton switch.

21. The system of claim 20 wherein the carrier frequency is in an ultra-high frequency band.

* * * * *

UNITED STATES PATENT AND TRADEMARK OFFICE

CERTIFICATE OF CORRECTION

PATENT NO. : 5,757,305

DATED : May 26, 1998

INVENTOR(S) : Thomas G. Xydis

It is certified that error appears in the above-indentified patent and that said Letters Patent is hereby corrected as shown below:

In Column 7, Line 63, delete Hz after 38 and insert --kHz -- in its place;

In Column 10, Line 26, before the word, signal, insert --a--.

Signed and Sealed this

Eleventh Day of August 1998

Bruce Lehman

*Attest:*

BRUCE LEHMAN

*Attesting Officer*

*Commissioner of Patents and Trademarks*